US007543990B2

(12) United States Patent
Michalsky

(10) Patent No.: US 7,543,990 B2
(45) Date of Patent: Jun. 9, 2009

(54) TUBULAR BAG

(75) Inventor: Andreas Michalsky, Memmingen (DE)

(73) Assignee: Zweigniederlassung der Huhtamaki Deutschland, Ronsberg-Allgau (DE)

( * ) Notice: Subject to any disclaimer, the term of this patent is extended or adjusted under 35 U.S.C. 154(b) by 584 days.

(21) Appl. No.: 10/857,257

(22) Filed: May 27, 2004

(65) Prior Publication Data

US 2005/0265636 A1 Dec. 1, 2005

(51) Int. Cl.
*B65D 30/16* (2006.01)

(52) U.S. Cl. ..... 383/104; 383/121.1

(58) Field of Classification Search ..... 383/104, 383/121.1; 220/254.1, 254.8, 601, 608, 615, 220/617, 677, 678, 680, 737, 739; 222/105, 222/106

See application file for complete search history.

(56) References Cited

U.S. PATENT DOCUMENTS

| | | | | | |
|---|---|---|---|---|---|
| 2,370,226 | A * | 2/1945 | Brede et al. | ..... | 150/154 |
| 3,313,333 | A * | 4/1967 | Lordi | ..... | 220/666 |
| 3,317,110 | A * | 5/1967 | Palmer | ..... | 229/5.5 |
| 3,519,158 | A * | 7/1970 | Anderson | ..... | 215/247 |
| 3,604,491 | A * | 9/1971 | Spiess | ..... | 383/80 |
| 3,832,964 | A * | 9/1974 | Rockefeller | ..... | 29/525 |
| 5,205,651 | A * | 4/1993 | Decottignies et al. | ..... | 383/119 |
| 5,350,240 | A * | 9/1994 | Billman et al. | ..... | 383/104 |
| 5,823,383 | A * | 10/1998 | Hins | ..... | 220/601 |
| 6,000,848 | A * | 12/1999 | Massioui | ..... | 383/80 |
| 6,334,710 | B1 * | 1/2002 | Kuge et al. | ..... | 383/104 |
| D476,565 | S * | 7/2003 | Rosen | ..... | D9/447 |
| 6,783,277 | B2 * | 8/2004 | Edwards et al. | ..... | 383/104 |
| 2003/0059130 | A1 * | 3/2003 | Yoneyama et al. | ..... | 383/10 |

FOREIGN PATENT DOCUMENTS

| | | |
|---|---|---|
| AT | 293 944 B | 10/1971 |
| AT | 293944 | 10/1971 |
| DE | 17 23 470 U | 5/1956 |
| DE | 1723470 | 5/1956 |
| DE | 202 14 197 U1 | 11/2002 |
| DE | 20214197 | 11/2002 |
| DE | 202 12 251 U1 | 1/2003 |
| DE | 20212251 | 1/2003 |
| EP | 03010827 | 1/2004 |
| JP | 2002 104446 | 4/2002 |
| JP | 2002104446 | 4/2002 |
| WO | WO 96/03281 | 2/1996 |
| WO | 0772522 | 5/1997 |

* cited by examiner

*Primary Examiner*—Nathan J Newhouse
*Assistant Examiner*—Jack H Morgan, Jr.
(74) *Attorney, Agent, or Firm*—Knobbe Martens Olson & Bear LLP

(57) ABSTRACT

A tubular bag with cap closure for the accommodation of fluid foodstuffs, wherein the base of the bag is constructed especially as a standing base and is welded or sealed fluid-tight with the bag as a separate component along the base-end bag edge, wherein the tubular part of the bag is manufactured from a single cut of film, especially a cut of laminated film, the longitudinal edges of which are sealed one over the other to form a "lap seal" (inner/outer seal) or alternatively constructed as a "fin seal" (inner/inner seal). A cap closure that is part of a relatively stiff cover is welded or sealed fluid-tight with the upper or closure-end bag edge. The tubular bag according to the invention has an enhanced filling capacity and improved stability.

28 Claims, 6 Drawing Sheets

TUBULAR BAG

BACKGROUND OF THE INVENTION

1. Field of the Invention

The invention concerns a tubular bag, especially with cap closure, for the accommodation of pasteurized products of fluid foodstuffs, for example milk or similar, wherein the base of the bag is constructed especially as a standing base and, if applicable, is welded or sealed fluid-tight with the bag as a separate component along the base-end bag edge.

2. Description of the Related Art

Tubular, especially sealed, bags are generally known. They are, as mentioned above, predominantly used to accommodate fluid or flowable products. They are convenient and practical to use. The products can be released from the sealed bag simply by squeezing it, provided the bag has an opening. Bags without such an opening generally have a tear-off closure. With respect to their packaging weight, the bags have compact packaging in comparison with cans or bottles for example and offer the advantage of a very low empty/full weight ratio.

A bag of this type is known from AT 293 944. This concerns containers constructed in the shape of a tube, wherein the tubular piece that forms the tube is sealed by welded seams at both tube ends running transversely to the longitudinal direction, wherein one of these welded seams forms a cone, into which a neck part of a closure equipped with a screw thread is sunken and connected by means of welding with the tubular part. The disadvantage of this tube is that the transversely running welded seam of the base does not permit the container to stand upright, which means this container cannot be set down like a bottle. Accordingly, in AT 293 944 a standing base, together with a tubular bag section constructed to be collapsible and flexible, is proposed.

The known construction, however, does not yet have the properties of a dimensionally stable bottle or an equally dimensionally stable can for the accommodation of drinks or similar.

Furthermore, the aforementioned tubular film bags of the type specified are used in many cases for filling with fluids. Since the starting point for manufacturing these stand-up bags is always a rectangular cut of film, conventional stand-up bags when full are considerably wider at the head area than at the base area. This is even more so the case the more the base of a full stand-up bag is spread out by the bag's contents. Such spreading does not take place in the head area, since there is always a closure part sunken into the head area and this prevents it from spreading apart. The longitudinal edges of the stand-up bag merge into a flat head seam. The disadvantage with this conventional embodiment is that, due to their flat head seams, the bags are pressed flat and therefore cannot be filled too close to the top, otherwise it would be not possible to prevent these bags from overflowing.

A further disadvantage of the aforementioned tubular bags is the low level of stability. The sealed bags known at present either have no standing base at all or have an oval-shaped standing base. These bases demonstrate, in a side view of the sealed bag, insufficient latitudinal extension in the z-direction, which means their stability is unsatisfactory. Since it is predominantly fluid contents that are distributed in such bags, this is particularly problematic, because if the bag falls over, its entire contents will pour out.

Attempts so far to provide a solution that offers high stability have used a firm, i.e. stiff, plastic insert to make the sealed bag stable. However, this measure has had a negative effect on the originally good empty/full weight ratio. Furthermore, the volume of waste produced by an empty or used sealed bag has increased, which is also disadvantageous.

SUMMARY OF THE INVENTION

Accordingly, an aim of the present invention is to create a tubular bag of the type mentioned at the start, which resembles a conventional bottle or drinks can or similar, wherein the construction is meant to be such that it is particularly suited to series production.

A further aim of the invention is to provide a stand-up bag that avoids the poor filling behavior caused by the aforementioned bag shape and that offers a larger internal filling capacity without use of additional material and that, whilst avoiding the aforementioned disadvantages, has a standing base that is inexpensive to manufacture.

One aspect of the present invention lies in the fact that the tubular part of the bag is manufactured from a single cut of film, especially a cut of laminated film, the longitudinal edges of which are sealed one over the other to form a "lap seal". Such an inner/outer seal has the advantage that there are no sealed edges protruding radially towards the outside. Accordingly, the tubular part of the bag may acquire the appearance of a conventional bottle or drinks can.

Alternatively a "fin seal" can be provided, by means of which the longitudinal edges of the cut of laminated film are sealed easily and cost-effectively with one another in order to create a fluid-tight seal or weld.

Furthermore, the cap closure may be a relatively stiff cover that is welded or sealed fluid-tight with the upper or closure-end bag edge. To this end, it is possible to use hot or cold sealing. This also applies to the following usage of the term "seal" or "sealed". The bag according to the invention acquires its basic profile from the relatively stiff cover, which can have a circular or oval or even rectangular circumferential profile. Furthermore, with the cap closure being constructed as a screw closure, this avoids the tubular part of the bag being scratched and therefore damaged when opening or closing said cap closure. To unscrew or screw on the screw closure, it is merely necessary to hold the tubular bag by the circumferential edges of its cover using the thumb and index finger of one hand in order to then unscrew or screw on the screw cap. In so doing, any damaging effect on the flexible part of the container or bag may be avoided.

Preferably, the standing base is also comprised of a relatively stiff part, for example a disc with a vertical circumferential edge, which, for connection with the tubular part of the bag, fits inside of this and is welded or sealed with this along the base-end circumferential edge of the tubular part. Alternatively, the standing base can be manufactured from a flexible disc with vertical circumferential edge. This involves a preformed flat-bottomed cup made of the same material as the tubular part of the bag.

There is also the option of manufacturing the standing base from a V or W-shaped folded cut of film, wherein the latter can be inserted into the inside of the bag by means of a blade engaged from below and can be welded or sealed with the lower bag edge to form a roughly U-shaped welded or sealed seam.

If the base is manufactured from a relatively stiff component, the whole bag, in conjunction with the relatively stiff cover, represents a dimensionally stable entity. It is suitable as a replacement for conventional bottles or cans, which in some countries are now subject to a deposit.

To manufacture the tubular part of the bag a film material is used, which preferably is plastically deformable, especially by blow-molding, to form a durable profile that is, for example, barrel or bullet-shaped or similar. It is also possible to impress a permanent relief-type surface structure in the tubular part of the bag.

In order to ensure a permanently high level of impermeability between cover and, if applicable, base on the one hand and tubular part of the bag on the other hand, the cover (and, if applicable, also the base) may have at least one circumferential groove or dent, into which the cut of film attached to a tube can be fitted using a designated tool during welding or sealing with the cover and/or base in such a way that the respectively designated circumferential edge of the tubular part of the bag sits snugly against the cover and, if applicable, the base over the entire circumference. Alternatively, it is also possible to use a type of shrink sealing along the cover and base circumferences. It is also possible to pressure-wrap the cut of film around the cover and base in order to manufacture, whilst maintaining the pressure, the aforementioned "lap-seal" seam.

Since the bag is manufactured from a single cut of film, "off-the-roll" manufacturing of the bag can occur. This simply requires that the individual cuts of film be cut off the respective film web and assigned to cover and base.

In order to enhance the weld or seal efficiency, the cover has a vertical circumferential edge with at least two, especially three, circumferential ribs arranged at an axial distance from one another, with which the designated edge of the tubular part of the bag can be welded or sealed. The standing base can also be constructed and welded in the same manner.

In some embodiments, the previous shortcoming in the poor filling capacity of the tubular bags mentioned at the start is solved by a tubular film bag, especially stand-up bag, with a closure part sealed in the area of a head seam and, if applicable, with a base, wherein the bag on both sides in the head area is pulled inwards diametric to the longitudinal axis, thus along its longitudinal edges, especially longitudinal seal seams, to form at least a W-fold (gusset), e.g. the bag is gusseted.

Owing to the gusset, the latitudinal extension in the head area of the tubular film bag is lower than with conventional stand-up bags. However, because of the gusset in the shape of a W-fold, the bag can spread out at right angles to the longitudinal axis of the bag and the width of the bag, e.g. in the z-direction, during filling. This is facilitated by the fact that initially the outer edges on the sides of the bag in the head area of the bag are pulled inwards on both sides in the direction of the closure part. During filling, this pull-in can unfold in the z-direction.

According to one embodiment of the invention, the W-fold, e.g. the gusset, is fixed in the area of a head seam by reciprocal sealing. On this occasion, four layers of film are positioned in the shape of a folded W, whereby one film layer, to create the V-fold at the centre of the W that is formed as a result of the pull-in, is sealed in between the films that form the outer flanks of the W in such a way that it is not possible for the pull-in, namely the V, to slip towards the outside. Therefore, the bag does not expand widthways, being held together as a result of the head seam, but instead expands in the z-direction. In so doing, the cross-section of the stand-up bag is optimized in the head area through the formation of a usable bag interior capacity that increases in the z-direction.

According to this embodiment, the tubular film bag when filled forms an approximately can-like shape, which, compared with conventional bags, offers improved stability, because the upper areas of the bag no longer protrude beyond the standing base and thus no longer create an imbalance. Furthermore, this bag shape is attractive because of its symmetry and produces a pleasant aesthetic effect.

According to another embodiment of the invention, a flat molded piece with a closure piece is sealed in between the gussets and head seam. On this occasion, the gussets may extend, depending on the embodiment of this molded piece, as far as this piece.

Owing to the gusset, the head seam in the head area is more robustly constructed, namely four-ply instead of two-ply. As a result of this reinforcement, the attachment of a molded piece is optimized. Furthermore, reinforcement of the head seam makes it easier to open a closure, especially a twist closure, compared with conventional tubular film bags because, thanks to this reinforcement, the entire head area can serve as a grip to hold on to when turning the twist closure, rather than holding on to only the flat molded piece.

According to another embodiment of the invention, the molded piece is circular, oval or acute oval-shaped. On this occasion, the respective embodiment is based on aesthetic considerations and can favorably enhance, for example, a design or a motif applied to the stand-up bag, thus further optimizing the aesthetic shape of the bag compared with conventional stand-up bags.

According to one advantageous embodiment, the tubular film bag is equipped on both sides with a double W-fold. In this embodiment there are two V-shaped pull-ins per longitudinal side of the tubular film bag. These four V-shaped pull-ins are arranged so as to encompass the flat molded piece. In this way it is possible to give the tubular film bag, especially stand-up bag, additional stability by fluting its longitudinal sides, especially in the head area, and thereby to prevent the risk of twisting.

According to another embodiment, the V-shaped pull-ins at both longitudinal sides of the tubular film bag can be arranged asymmetrically. One implementation option consists, for example, of having single gusseting on one longitudinal side of the tubular film bag and two-fold gusseting on the diametrically opposed longitudinal side. In this way it is possible, for example, to produce a tubular film bag that in a filled state is approximately triangular in shape at the head area.

According to another embodiment of the invention, the tubular film bag is sealed at the base end either by a base seam or by a base that is sealed in separately. Such a base seam could, for example, be constructed in the shape of a W-fold, the outer edges of which run parallel to the longitudinal axis of the bag and are sealed in such a way that a W is formed when the bag is full and the central fold of this W pulls apart during filling so that an oval or a circular base is formed. This embodiment is particularly advantageous because the tubular film bag is conveniently manufactured from a single cut of film, which is possible with this base design. In this embodiment, the base area is four-ply sealed to the side edges. Above the base area, the four-ply seal changes to a two-ply seal.

The above embodiment is particularly suitable for a fin-seal bag that has side seal seams.

According to another embodiment, which is particularly suitable for a lap-seal bag without side seams, a separate base is sealed into the tubular bag. Sealing in a base in this way offers the advantage that the tubular bag can be filled at the base end rather than at the head end. Since the base-end opening is always larger than the head-end opening, filling can be faster if effected at the base end.

Furthermore, a lap-seal bag is particularly suitable for the construction of a W-fold, which is pulled-in in the head area, because a lap-seal bag is flexible at its side edges and therefore easy to pull together to form a W-fold.

In summary, it can be noted that, in addition to a visually optimized design, the new stand-up bag shape also offers a greater filling capacity in the upper bag area, which means the bag can be filled closer to the top.

The stability of the tubular bag according to some embodiments of the invention is achieved by means of a tubular sealed bag, wherein, prior to being inserted into the tubular part of the sealed bag, the base is manufactured from a rectangular, especially square, cut of film in such a way that the cut of film is folded and sealed along the superimposed, now shorter edges.

Another aspect of some embodiments of the invention is that a cut of film, essentially rectangular, especially square or, with respect to its side edges, slightly pulled in at the fold-over area, is used to form a standing base for the sealed tubular bag. Such a cut of film can be manufactured from the same material, especially from the same film web, as the sealed bag. The size of the standing surface and the stability of the bag are defined by the size of the rectangular cut of film and by the width of the sealed edges in the tubular part of the sealed bag and in the cut of film. This happens as follows:

A cut of film is used, the width of which corresponds to the width that will later be required for the standing area of the sealed bag and for an edge area for a seal surface of the base. The depth, e.g., the z-direction of the standing base, is determined by the length of the cut of film. The cut of film is folded in the centre parallel to its latitudinal extension so that the longitudinal edges of the cut of film become the now shorter, superimposed edges of the folded cut of film. These shorter superimposed edges are sealed to produce a pocket, the outer edges of which have a fin-type seal.

According to a preferred embodiment of the invention, the cut of film is sealed in such a way that when turned in the direction of insertion, it passes easily as a cone shape into the tubular part of the sealed bag. In this manner, the base can be easily pushed into the film tube.

When the base is turned, the pocket reveals a smooth outer edge, which conforms most favorably to the round, tubular part of the sealed bag.

The pocket is sealed into the tubular part of the sealed bag with a sealed edge that runs at the bottom all the way around the base. The stability of the base and of the bag is determined by the width of this edge. Thus, a wider edge offers greater stability and, furthermore, in the case of a filled bag, ensures that the base will not turn back outwards.

Sealing may be performed using a sealing medium. The sealing medium is preferably sealing film, which is used as the inner layer of the base and which, with the application of pressure and/or heat, self seals in the areas where heat or pressure is applied, or which, when the base is turned, seals against a corresponding inner sealing film in the tubular part of the sealing bag. It is possible, however, to use other sealing materials and adhesives to this end.

The pocket manufactured from the cut of film is turned inside out so that the sealing medium initially on the inside is now on the outside. In this respect, it should be mentioned that the sealing medium is allocated at least along the edges of the original cut of film.

This inside-out pocket is now, according to one embodiment of the invention, inserted into the tubular part of the sealed bag and sealed with the circumferential edge of the sealed bag in such a way that a tubular stand-up bag is produced, wherein the shorter sealed edges of the base are located within the stand-up bag. The essential advantage of having a base manufactured separately from a cut of film is that the size and standing area of the base can be specified exactly. In this manner, it is possible to specify exactly the latitudinal extension as well as the expansion of the base in the z-direction, whereby only the circumference of the tubular stand-up bag needs to be taken into consideration. It is easily possible to create a circular standing base, which practically eliminates the risk of the stand-up bag falling over.

According to another embodiment of the invention, it is not absolutely necessary to turn the pocket prefabricated from a cut of film inside out, because its fin-seal edges can always be folded back in order that the prefabricated base can be inserted into the tubular part of the sealed bag and sealed with its circumferential edges. In both cases, insertion is executed such that the pocket manufactured from the cut of film is inserted into the tubular part of the sealed bag in such a way that the opening of the pocket is accessible from the outside, even after the pocket has been sealed in the tubular part of the sealed bag, so that the inside of the pocket provides the standing surface of a filled sealed bag.

According to another embodiment of the invention, the tubular bag is manufactured from a cut of film that is sealed along one side seam, wherein the longitudinal seal seam is constructed as a lap seal or as a fin seal. Thus the base manufactured from the cut of film can be used for all tubular sealed bags. As a result, tubular sealed bags have an, in effect, essentially circular base, which is airtight as a result of being sealed with the tubular part of the sealed bag.

BRIEF DESCRIPTION OF THE FIGURES

The embodiments of the bag according to the invention are described in more detail below with reference to the enclosed drawings.

DETAILED DESCRIPTION

Figure 1:
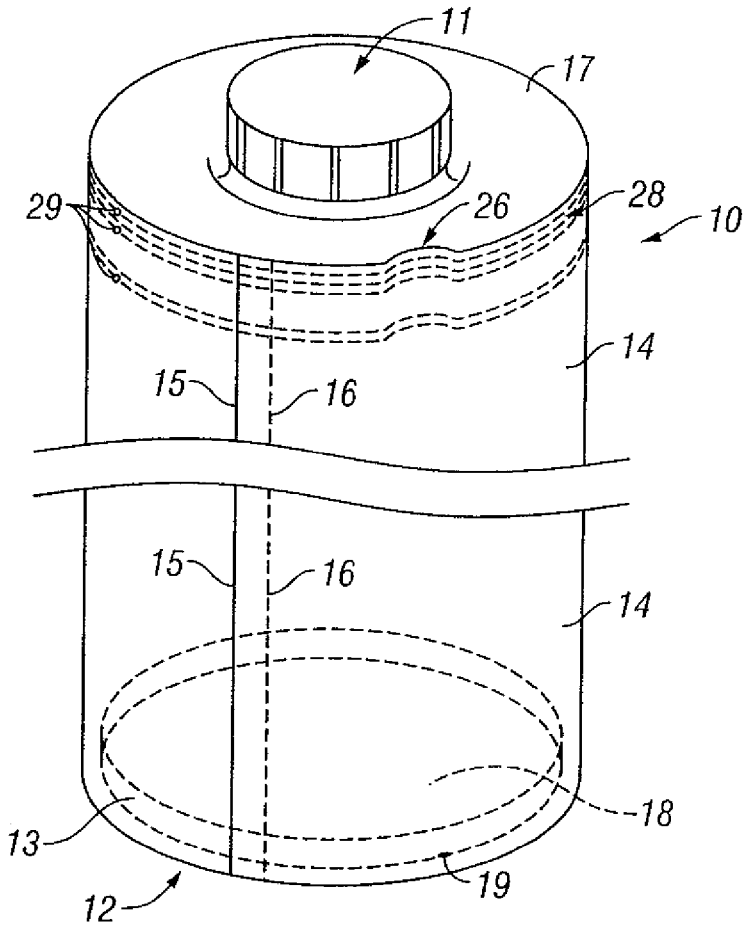
FIG. 1: A tubular bag according to the invention in perspective view.

The tubular bag 10 represented schematically in FIG. 1 has a cap closure 11 and serves to accommodate pasteurized products or fluid foodstuffs, for example milk, lemonade, mineral water or similar. The base 12 is constructed as a standing base and is especially welded or sealed fluid-tight as a separate component along the base-end edges of the bag. The corresponding sealed edge 13 is represented in FIG. 1 as a broken line. The tubular part 14 of the bag 10 is manufactured from a single cut of film, especially laminated film (rectangular cut of film). The longitudinal edges 15 and 16 are sealed one over the other to form a "lap seal". This entails inner/outer sealing without forming a sealed edge that protrudes radially towards the outside. This gives an extremely smooth surface to the tubular part 14 of the bag 10 over the entire circumference.

The cap closure 11 is part of a relatively stiff cover 17, which is welded or sealed fluid-tight with the upper or closure-end bag edge.

According to FIG. 1, the standing base 12 may consist of a relatively rigid disc 18 with a vertical circumferential edge 19. As such, the base 12 forms a kind of flat-bottomed cup, which is inserted into the tubular part 14 of the bag 10 with the vertical circumferential edge entering first or subsequently (as shown in FIG. 1) and is then welded or sealed with the inside of the designated circumferential edge of the tubular part 14.

Figure 1A:
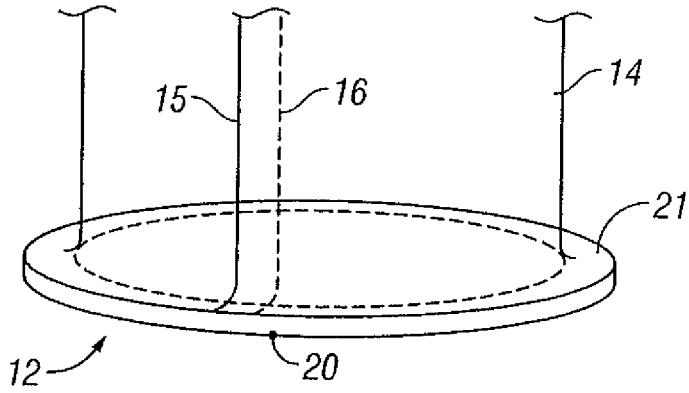
FIG. 1*a*: An alternative bag base construction according to FIG. 1 in perspective view.

Alternatively, according to FIG. 1*a*, the base may consist of a flexible disc 20, the circumference of which is welded or sealed with a circumferential edge 21 of the tubular part 14 of the bag 10, which edge is shaped to face outwards. A high level of stability of the bag 10 is also achieved with this construction, in the manner of a bottle or similar.

According to FIGS. 1*c* and 1*d*, the standing base may alternatively be manufactured from a V or W-shaped folded cut of film 22, wherein this cut of film can then preferably be inserted into the inside of the bag by means of a blade engaged from below (arrow 23 in FIG. 1*d*) and can be welded or sealed with the lower edge of the bag to form a roughly U-shaped welded or sealed seam 24. The sealed seam 24 is preferably constructed in such a way that the seal line extends across the area of the circumferential edge 32 that is outermost at the base end. In this embodiment, when the bag 10 is filled the base 12 can spread relatively unimpeded until it is almost flat. In this embodiment, the V or W-shaped prefolded base piece is presealed before insertion into the tubular part 14 of the bag 10. Alternatively, it is also possible, of course, to seal the base after the base piece has been inserted into the tubular part 14 of the bag 10. The longitudinal edge of the V or W-shaped folded cut of film 22 that points inwards is identified in FIGS. 1*c* and 1*d* with the reference number 25.

Figure 1B:
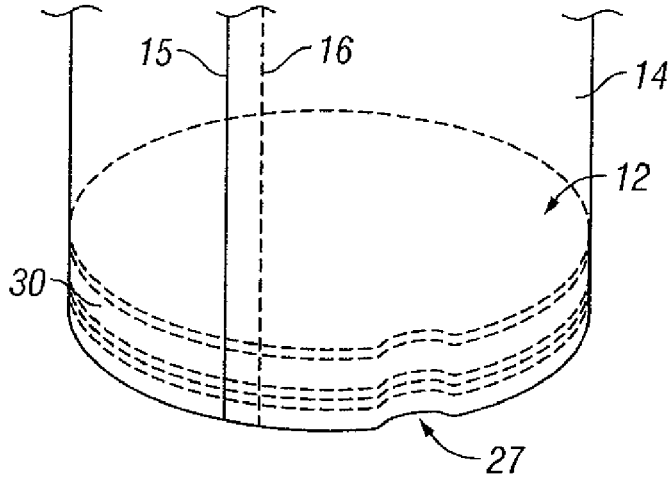
FIG. 1*b*: Another alternative embodiment of the tubular bag base construction according to FIG. 1 in perspective view.
Figure 1C:
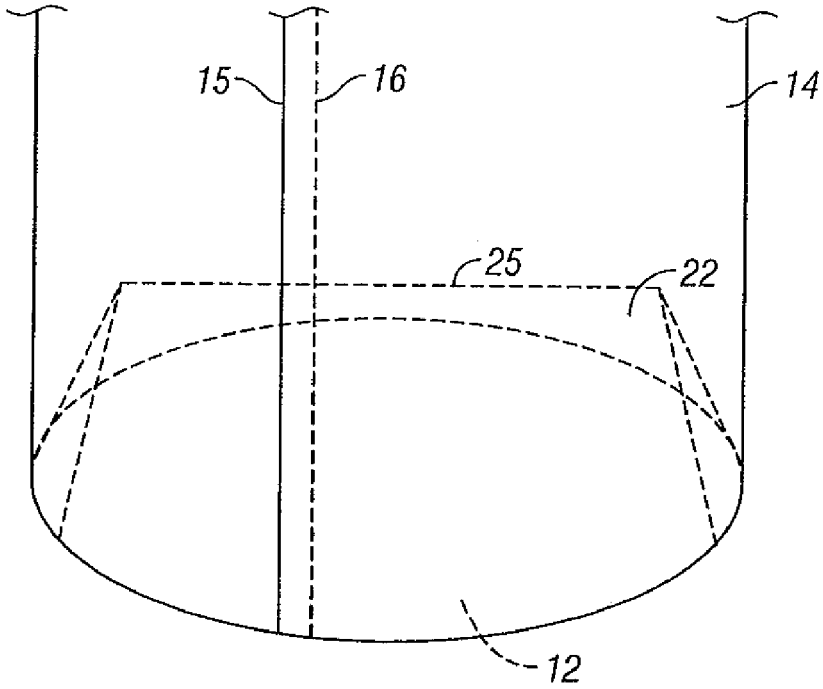
FIG. 1*c* and 1*d*: A third alternative tubular bag base construction according to FIG. 1 in perspective view and in side view.
Figure 1D:
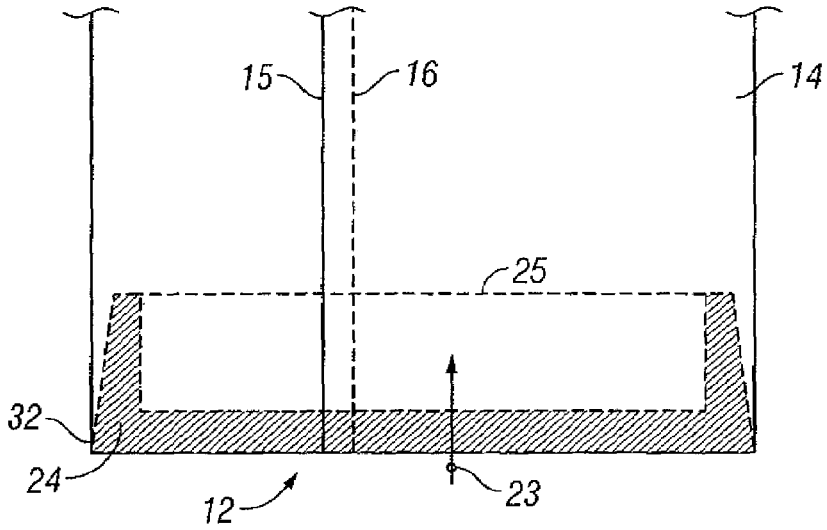

As FIG. 1 with respect to the cover 17 and FIG. 1*b* with respect to the standing base 12 clearly demonstrate, the cover 17 and the standing base 12, if manufactured from a relatively stiff material, have at least one circumferential groove or dent 26 and 27, into which the cut of film attached to a tube can be fitted using a designated tool, which is not represented in detail here, during welding or sealing with the cover and, if applicable, the base in such a way that the respectively designated circumferential edge of the tubular part 14 of the bag 10 sits snugly against the cover 17 and, if applicable, the base 12 over the entire circumference.

According to FIG. 1, the cover 17 has a vertical circumferential edge 28, which when assembled according to FIG. 1 projects into the inside of the bag. This circumferential edge has at least two, here three, circumferential ribs 29 arranged in axial distance from one another, with which the designated edge of the tubular part 14 of the bag 10 can be welded or sealed. Similarly, the circumferential edge 30 of the standing base 12 according to FIG. 1*b* can have circumferential ribs. These circumferential ribs are merely graphically suggested in FIG. 1*b*.

As already mentioned at the start, the cap closure preferably comprises a screw cap. However, it is also possible to use a plug-type cap or similar as the closure.

Figure 2:
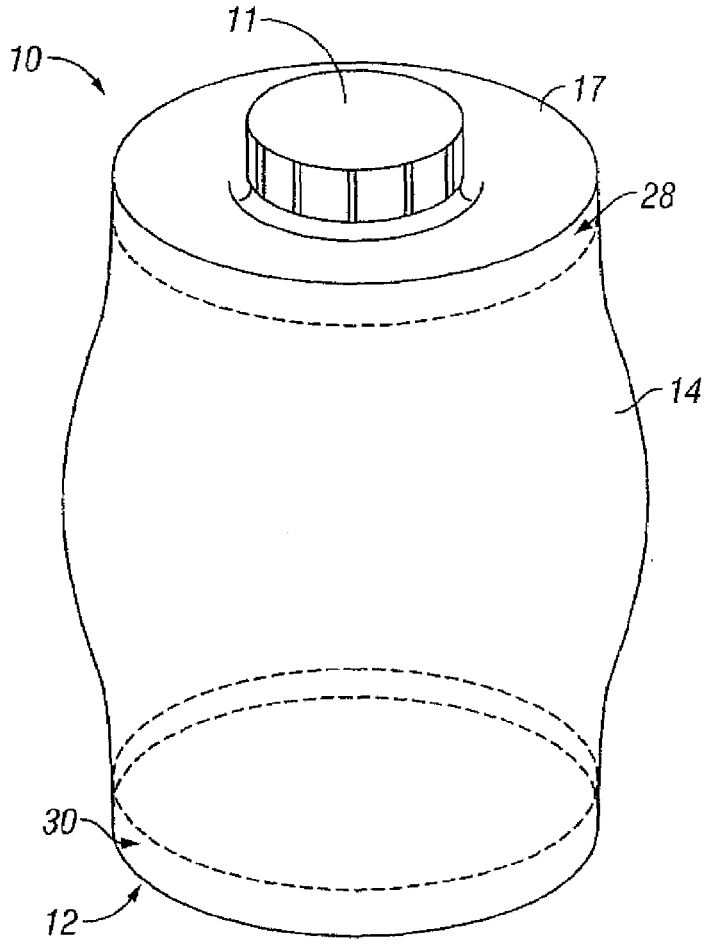
FIG. 2: Another embodiment of a bag according to the invention in perspective view.

In FIG. 2 an alternative embodiment of a tubular bag 10 is represented, wherein the tubular section or part 14 is "bellied out" radially towards the outside within a corresponding mold, especially blow mold. This preferably involves lime deformation of the film used for the tubular part 14. Naturally, any other profile, especially a rotationally symmetrical profile, of the tubular part 14 of the bag 10 is also possible. This depends on the requirements of the customer and the corresponding mold for manufacturing the desired profile.

With respect to the advantageousness of the bag described, it should also be mentioned that the bag is also especially suited to accommodate fruit juices with low amounts of CO2. The demand for drinks with a low amount of CO2 is growing increasingly stronger. Accordingly, there is obviously no additional need to create a container that can withstand the relatively high pressures generated when filled with drinks containing CO2. On the other hand, in such a case, it is possible to use material with a high level of heat-resistance. Consequently, the foodstuffs used to fill the bag described may, without any problem, be pasteurized or heat-treated to preserve them. Preferably, the filling process is carried out at the cover end. After filling, the cap closure is attached, preferably in conjunction with a security strip, familiar from bottle closures.

Figure 3:
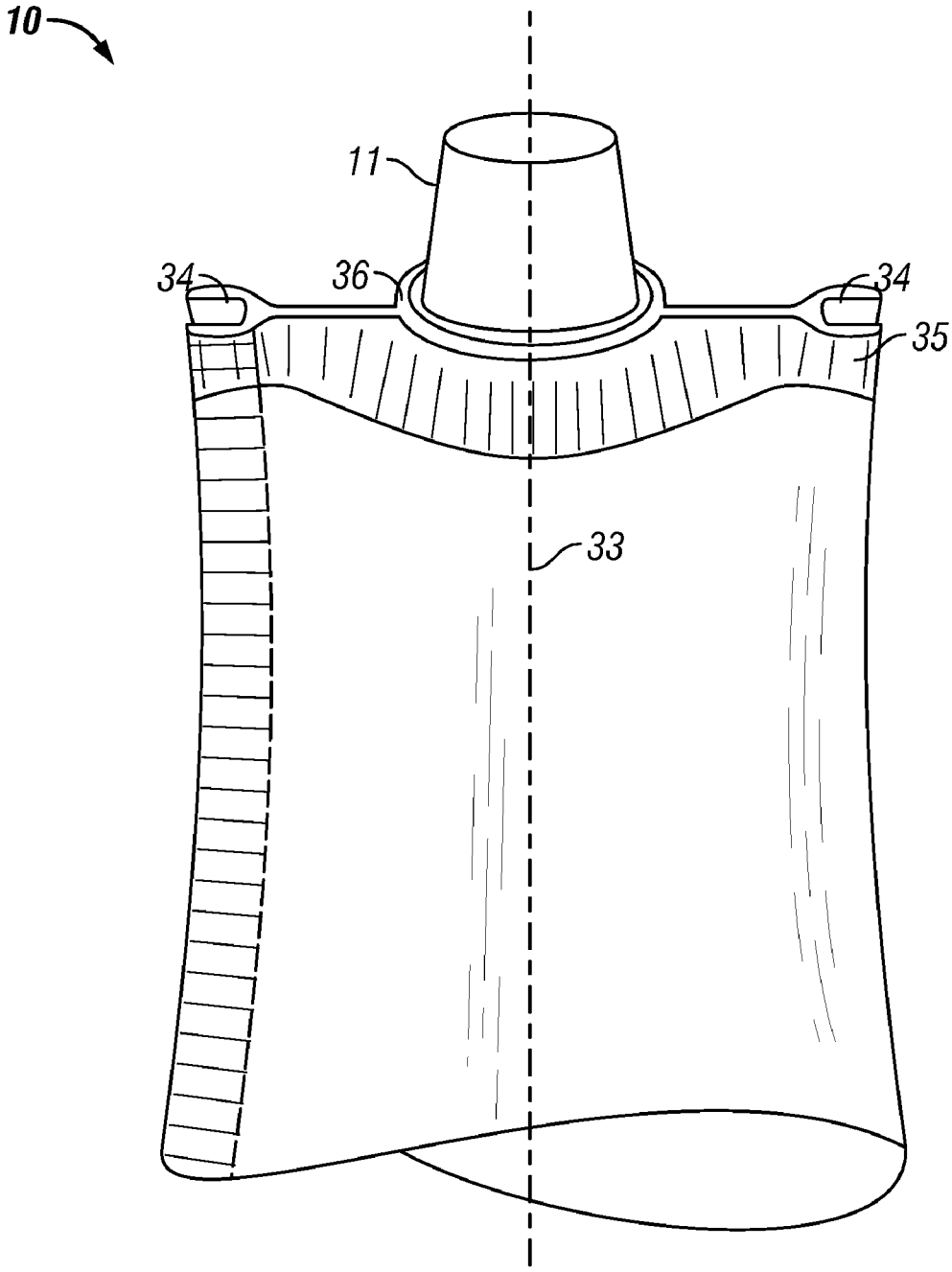
FIG. 3 (Prior Art)
FIG. 3: A schematic representation of another embodiment of the tubular film bag according to the invention.
Figure 4:
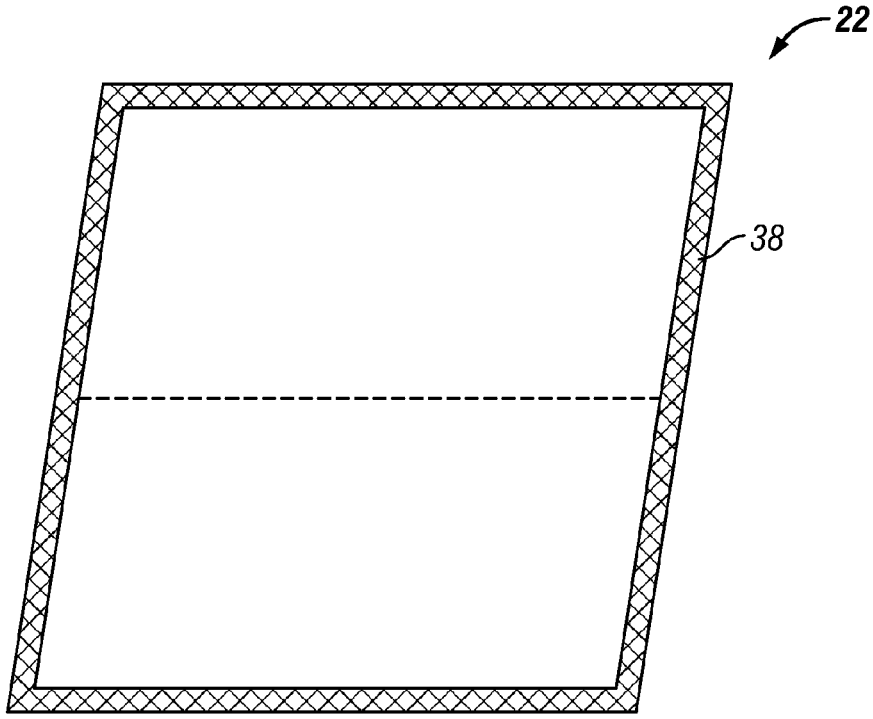
FIG. 4 (Prior Art)
FIG. 4: A schematic representation of a cut of film for manufacturing another alternative standing base according to the invention.
Figure 5:
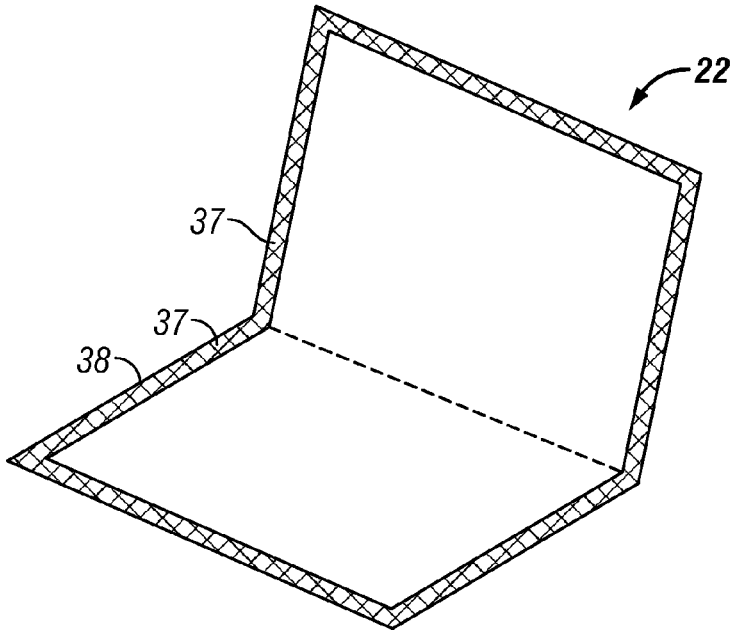
FIG. 5 (Prior Art)
FIG. 5: A folded embodiment of the cut of film from FIG. 4.
Figure 6:
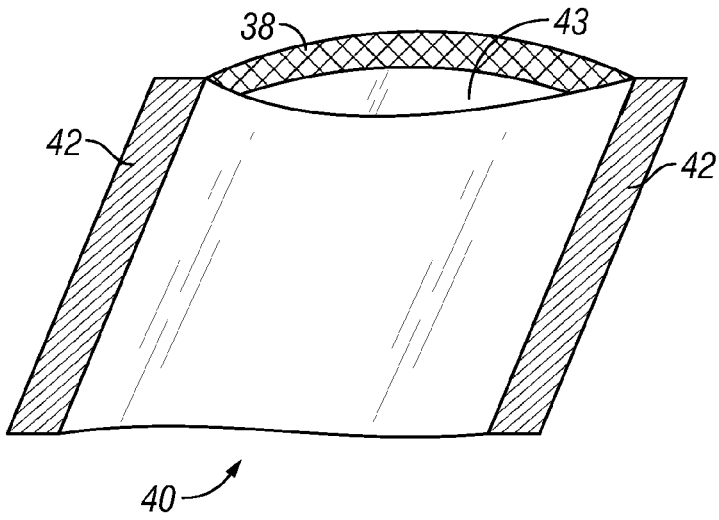
FIG. 6 (Prior Art)
FIG. 6: A completely folded and edge-sealed embodiment of the cut of film from FIGS. 4 and 5.
Figure 7:
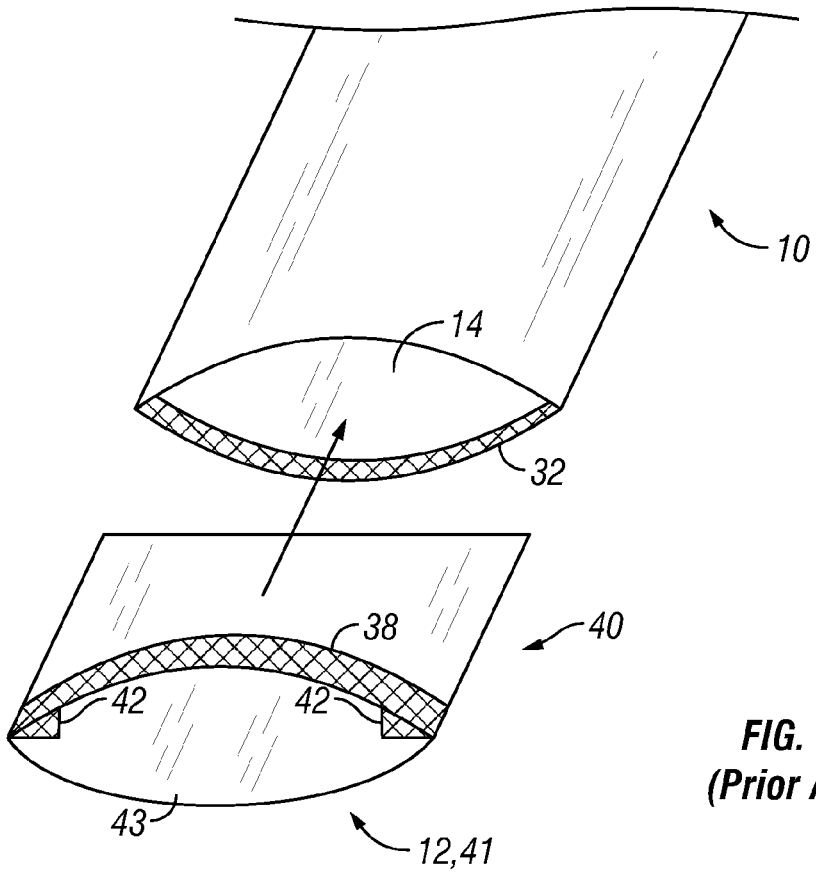
FIG. 7 (Prior Art)
FIG. 7: A schematic representation of the insertion of the standing base according to the invention into a tubular sealed bag.

FIG. 3 shows a schematic representation of a tubular film bag according to one embodiment of the invention. In the area of a head seam 35, a side area of the tubular film bag is pulled in diametric to a longitudinal axis 33 of the bag on both sides of the bag 10, in the area of its edge(s), to form a W-fold 34. The W-fold 34 forms a gusset. In addition, a closure part 11 is arranged in the area of the head seam 35. The closure part 11 is located on a flat molded piece 36, which is sealed into the head seam.

The schematic representation in FIG. 3 also demonstrates that the tubular film bag according to the invention is suited to both a fin-seal seam (left area) and a seamless embodiment (right area). In the area of the fin-seal seam, the W-fold is 6-ply sealed (not depicted), whilst the W-fold in the area of the seamless pull-in is 4-ply sealed.

According to FIGS. 4 to 7, a square cut of film 22 with a width of 11 cm is provided at the edges, in an area that extends 5 mm in from the outside edge, with sealing film, which serves as the sealing medium. After this, the cut of film 22 is folded in the centre parallel to a latitudinal extension so that the edge areas 38 with sealing film sit one over the other. The narrow edge areas 37 are sealed together in such a way that the sealing film seals against itself. Then the cut of film 22, which forms a pocket, is turned inside out in order that the fin-seal edges 42 formed from the narrow sealed edges 37 end up inside the pocket. After this, this inside-out pocket 40, which now has a latitudinal extension of 10 cm, is inserted into the tubular part 14 of a sealed bag 10, which when empty and flat has a latitudinal extension of 100.5 mm, i.e. it is slightly wider than the inside-out pocket 40, until the edges of the pocket are flush with the edges 32 of the tubular part 14 of the sealed bag 10. The sealing film applied to the cut of film 22 is now in direct contact with the edge area 32 of the tubular part 14 of the sealed bag 10. Sealing takes place in such a way that the sealing film-covered edge area 38 of the pocket 40 manufactured from the cut of film 22 and turned inside-out is sealed with the edge area 32 of the tubular part 14 of the sealed bag 10 with the result that, when the seal bag 10 is filled, a standing surface 41 is formed.

Once the sealed bag 10 has been filled, the base 12 manufactured from the pocket 40 deforms in such a way that it creates a circular base 12, which is hermetically sealed with the tubular sealed bag 10.

The result is a stand-up bag with optimum standing properties that is simple and cost-effective to manufacture and which offers the advantage that the sealed bag can be filled at any time from the base end and which can be collapsed to make it small and without hard parts for disposal.

At this juncture, it should be pointed out that all the parts described above have been claimed for themselves alone and in any combination, especially the details described in the drawing. Revisions to this are familiar to the man skilled in the art.

List Of Reference Numerals

10 tubular bag
11 cap closure
12 (standing) base
13 sealed edge
14 tubular part
15 longitudinal edge
16 longitudinal edge
17 cover
18 disc
19 circumferential edge
20 flexible base disc
21 circumferential edge
22 cut (of film)
23 arrow
24 U-shaped seal seam
25 edge
26 groove
27 groove
28 circumferential edge
29 circumferential ribs
30 circumferential edge
31 screw cap
32 base edge
33 longitudinal axis of bag
34 W-fold
35 head seam
36 molded piece
37 edges (of the cut of film)
38 edge area for seal surface
39 centre fold
40 pocket
41 standing surface
42 fin-type seal
43 interior of the pocket

What is claimed is:

1. A tubular bag with cap closure for the accommodation of fluid foodstuffs, wherein the base of the bag is constructed as a standing base and is welded or sealed fluid-tight with the bag as a separate component along the inside surface of the base-end bag edge, and wherein the cap closure is part of a relatively stiff cover, which is fluid-tight welded or sealed along the inside surface of the upper or closure-end bag edge, and wherein the cover and the standing base each have at least one indentation with a circumferentially extending width so that the tubular bag can be fitted with the cover and base in such a way that the respectively designated circumferential edge of the tubular bag sits snugly against the cover and the base over the entire circumference, wherein the width of the indentation does not extend continuously around the circumference of the cover or base, and wherein a seam of the tubular bag is not aligned with at least one of the indentations.

2. A bag according to claim 1, wherein the standing base comprises a relatively rigid disc with vertical circumferential edge.

3. A bag according to claim 1, wherein the tubular part of the bag can be plastically deformed within a mold to form a durable profile.

4. A bag according to claim 1, wherein the cover has a vertical circumferential edge with at least two circumferential ribs arranged in axial distance from one another, with which the designated edge of the tubular part of the bag can be welded or sealed.

5. A bag according to claim 1, wherein the cap closure comprises a screw cap.

6. A bag according to claim 1, wherein the cover is constructed to form a circular, oval or acute oval shape.

7. A bag according to claim 1, wherein said indentation has a radially extending depth and an axially extending length.

8. A tubular bag with cap closure for the accommodation of fluid foodstuffs, wherein the base of the bag is constructed as a standing base and is welded or sealed fluid-tight with the bag as a separate component along the inside surface of the base-end bag edge, and wherein the cap closure is part of a relatively stiff cover, which is fluid-tight welded or sealed along the inside surface of the upper or closure-end bag edge, and wherein the cover has at least one indentation with a circumferentially extending width so that the tubular bag can be fitted with the cover in such a way that the respectively designated circumferential edge of the tubular bag sits snugly against the cover over the entire circumference, wherein the width of the indentation does not extend continuously around the circumference of the cover, and wherein a seam of the tubular bag is not aligned with the indentation.

9. A bag according to claim 8, wherein the tubular part of the bag can be plastically deformed within a mold to form a durable profile.

10. A bag according to claim 8, wherein the cover has a vertical circumferential edge with at least two circumferential ribs arranged in axial distance from one another, with which the designated edge of the tubular part of the bag can be welded or sealed.

11. A bag according to claim 8, wherein the base is constructed from a relatively stiff or rigid or alternatively flexible disc, the circumferential edge of which is welded or sealed with the circumferential edge of the tubular part of the bag, which edge is deformed at its base somewhat radially towards the outside.

12. A bag according to claim 8, wherein the cap closure comprises a screw cap.

13. A bag according to claim 8, wherein the cover is constructed to form a circular, oval or acute oval shape.

14. A bag according to claim 8, wherein the bag is sealed at its base by a base seam.

15. A bag according to claim 8, wherein said indentation has a radially extending depth and an axially extending length.

16. A bag according to claim 8, wherein the standing base comprises a V or W-shaped folded cut of film, wherein the latter can be inserted into the inside of the bag by means of a blade engaged from below and can be welded or sealed with the lower bag edge to form a roughly U-shaped welded or sealed seam.

17. A bag according to claim 16, wherein prior to insertion into the tubular part of the sealed bag, the base is manufactured from a rectangular or square cut of film in such a way that the cut of film is folded and sealed along the superimposed, now shorter edges.

18. A bag according to claim 17, wherein the presealed base is inserted inside out into the tubular part of the sealed bag and is sealed with its circumferential and base edge producing a tubular stand-up bag, wherein the short sealed edges of the base are located within the stand-up bag.

19. A tubular bag with cap closure for the accommodation of fluid foodstuffs, wherein the base of the bag is constructed as a standing base and is welded or sealed fluid-tight with the bag as a separate component along the inside surface of the base-end bag edge, and wherein the cap closure is part of a relatively stiff cover, which is fluid-tight welded or sealed along the inside surface of the upper or closure-end bag edge, and wherein the standing base has at least one indentation with a circumferentially extending width so that the tubular bag can be fined with the base in such a way that the respectively designated circumferential edge of the tubular bag sits snugly against the base over the entire circumference, wherein the width of the indentation does not extend continuously around the circumference of the base, and wherein a seam of the tubular bag is not aligned with the indentation.

20. A bag according to claim 19, wherein the standing base comprises a relatively rigid disc with vertical circumferential edge.

21. A bag according to claim 19, wherein the tubular part of the bag can be plastically deformed within a mold to form a durable profile.

22. A bag according to claim 19, wherein the cap closure comprises a screw cap.

23. A bag according to claim 19, wherein the cover has a vertical circumferential edge with at least two circumferential ribs arranged in axial distance from one another, with which the designated edge of the tubular part of the bag can be welded or sealed.

24. A bag according to claim 23, wherein said indentation has a radially extending depth and an axially extending length.

25. A bag according to claim 19, wherein the bag on both aides in the head area is pulled inwards diametrically to the longitudinal axis to form a W-fold.

26. A bag according to claim 25, wherein the W-fold is fixed in the area of a head seam by reciprocal sealing.

27. A bag according to claim 25, wherein the cover is constructed as a flat molded piece with a closure opening and is sealed in place between the W-folds and the head seam.

28. A bag according to claim 27, wherein the molded piece is constructed to form a circular, oval or acute oval shape.

* * * * *

UNITED STATES PATENT AND TRADEMARK OFFICE

CERTIFICATE OF CORRECTION

PATENT NO. : 7,543,990 B2
APPLICATION NO. : 10/857257
DATED : June 9, 2009
INVENTOR(S) : Andreas Michalsky It is certified that error appears in the above-identified patent and that said Letters Patent is hereby corrected as shown below:

At column 11, line 8, in Claim 19, please change "fined" to --fitted--.

At column 12, line 10, in Claim 25, please change "aides" to --sides--.

Signed and Sealed this

First Day of June, 2010

David J. Kappos

David J. Kappos
*Director of the United States Patent and Trademark Office*